US009943852B2

(12) United States Patent
Lönngren

(10) Patent No.: US 9,943,852 B2
(45) Date of Patent: Apr. 17, 2018

(54) CENTER PLATE IN A PULP REFINER

(71) Applicant: Valmet AB, Sundsvall (SE)

(72) Inventor: Karl Lönngren, Stockholm (SE)

(73) Assignee: Valmet AB (SE)

( * ) Notice: Subject to any disclaimer, the term of this patent is extended or adjusted under 35 U.S.C. 154(b) by 205 days.

(21) Appl. No.: 14/772,852

(22) PCT Filed: Mar. 4, 2014

(86) PCT No.: PCT/SE2014/050260
§ 371 (c)(1),
(2) Date: Sep. 4, 2015

(87) PCT Pub. No.: WO2014/142732
PCT Pub. Date: Sep. 18, 2014

(65) Prior Publication Data

US 2016/0023216 A1 Jan. 28, 2016

(30) Foreign Application Priority Data

Mar. 12, 2013 (SE) ..... 1350290

(51) Int. Cl.
*B02C 7/00* (2006.01)
*B02C 7/12* (2006.01)
(Continued)

(52) U.S. Cl.
CPC ..... *B02C 7/12* (2013.01); *B02C 7/06* (2013.01); *D21D 1/30* (2013.01)

(58) Field of Classification Search
CPC ..... B02C 7/12; B02C 7/06; D21D 1/30
See application file for complete search history.

(56) References Cited

U.S. PATENT DOCUMENTS 11,372 A 7/1854 Gaines
100,537 A 3/1870 Loy
(Continued)

FOREIGN PATENT DOCUMENTS

CN 101773863 A 7/2010
CN 202199376 U 4/2012
(Continued)

OTHER PUBLICATIONS

Supplementary European Search Report for Application No. EP14762429 dated Jul. 12, 2016.
(Continued)

*Primary Examiner* — Faye Francis
(74) *Attorney, Agent, or Firm* — Lerner, David, Littenberg, Krumholz & Mentlik, LLP

(57) ABSTRACT

A center plate for a rotor in a pulp refiner is described in which the center plate is provided with a plurality of first wings for directing pulp flowing onto the center portion of the center plate towards the periphery of the center plate, each of the first wings comprising an arc-shaped protrusion extending between a corresponding first point and a corresponding second point on the surface of the center plate, the first point being displaced from the center portion of the center plate and the second point being disposed further from said center portion of the center plate then the first point, the first wings having an arc shape that yields a larger pulp feeding angle then that of a circular arc intersecting the center portion of the center plate and ending in the same corresponding second point, and the second point of each of the first wings lies on the periphery of the center plate.

8 Claims, 12 Drawing Sheets

(51) Int. Cl.
*D21D 1/30* (2006.01)
*B02C 7/06* (2006.01)

(56) References Cited

U.S. PATENT DOCUMENTS

| | | | | |
|---|---|---|---|---|
| 3,902,673 | A | 9/1975 | Berggren | |
| 4,023,737 | A | 5/1977 | Leider et al. | |
| 4,396,161 | A | 8/1983 | Ruokolainen et al. | |
| 6,206,309 | B1 | 3/2001 | Danielsson et al. | |
| 6,402,071 | B1 | 6/2002 | Gingras | |
| 9,211,546 | B2 * | 12/2015 | Hackl | B02C 18/182 |
| 9,539,741 | B2 * | 1/2017 | Hackl | B02C 18/086 |

FOREIGN PATENT DOCUMENTS

| | | | |
|---|---|---|---|
| GB | 509911 | A | 7/1939 |
| WO | 9525199 | A1 | 9/1995 |
| WO | 9954046 | A1 | 10/1999 |
| WO | 03090931 | A1 | 11/2003 |
| WO | 2011077422 | A1 | 6/2011 |

OTHER PUBLICATIONS

Chinese Office Action for Application No. 201480005175.X dated Apr. 5, 2016.
Chinese Office Action for Application No. 201480005175.X dated Nov. 14, 2016.
International Search Report for Application No. PCT/SE2014/050260 dated Jun. 11, 2014.

* cited by examiner

CENTER PLATE IN A PULP REFINER

CROSS REFERENCE TO RELATED APPLICATION

This application is a national phase entry under 35 U.S.C. § 371 of International Application No. PCT/SE2014/050260, filed Mar. 4, 2014, which claims priority to Swedish Patent Application No. 1350290-1, filed on Mar. 12, 2013, the disclosures of which are incorporated herein by reference.

FIELD OF THE INVENTION

The present invention relates to the field of pulp refiners. More specifically it relates to a center plate for a rotor and a pulp refiner comprising a rotor with such center plate.

BACKGROUND OF THE INVENTION

To mechanically refine pulp in an effective way to e.g. produce paper is a non-trivial subject. A plethora of refiners and refiner elements have been designed in order to further improve the mechanical refining action on the pulp.

A commonly used pulp refiner comprises a rotor unit and a stator unit that are aligned along a pulp feeding axis facing each other. The refining of the pulp is performed in a bounded area between the rotor unit and the stator unit. During use of the pulp refiner pulp is fed via a feeding channel through a hole in the stator unit to emerge in an area bounded by the stator unit and the rotor unit. The rotor unit facing the stator unit is arranged on a rotatable axis that can be rotated by means of an electrical motor. The purpose of the rotor unit, which in the following will be simply referred to as a rotor, is to grind the pulp between a surface of the stator unit and a surface of the rotor. Thus, when pulp leaves the feeding channel and enters the bounded area between the rotor and the stator through a hole provided in the stator it flows in on the rotor and due to the rotation of said rotor the pulp is directed outwards towards the boundaries of the rotor and stator. On the boundaries there are usually provided refining segments on the surfaces of the rotor and/or the stator. The purpose of these refining segments is to improve the grinding action on the pulp.

One problem with such designs is that the pulp will be directed towards the boundaries in an uneven fashion. Large chunks of pulp will be localized in a particular position on the rim of the rotor/stator arrangement while other positions will be more or less devoid of pulp. This will in turn lead to uneven grinding of the pulp. Thus efforts have to be made to improve the distribution of the pulp.

Another problem within the art is that part of the pulp initially can get stuck in the middle of the center plate. This might lead to pulp piling up in the middle of the center plate which can negatively affect the pulp distribution. It is therefore also a need for a center plate design that opposes that pulp gets piled up in the middle of the center plate.

A known measure to achieve such a pulp distribution is to provide the center plate of the rotor surface with a set of wings or wing profiles, whose purpose is to direct the pulp more evenly towards the rim of the stator/rotor arrangement. These wings are protrusions provided on the surface of the rotor facing the incoming pulp. The wings are mostly curved to obtain an arc-shaped form. By means of such wings pulp will be directed into the open channels defined between adjacent wings to thereby give a more even distribution of the pulp in the refining area. The constraints regarding the design of the wings constitute a very delicate dynamic problem where such phenomena as flow turbulence of the pulp have to be taken into consideration. This makes mathematical modeling of the dynamics intractable and direct observation of the wings effect on the dynamics is also complicated, partly due to the smallness of the refining area.

Several attempts have been made to improve the distribution of pulp. In U.S. Pat. No. 3,902,673 there is disclosed a refining machine for fragmented beating material. The machine comprises a rotationally symmetric annular infeed channel formed between a central body and an outer part surrounding the central body. The infeed channel has an increasing inner and outer diameter in the material feeding direction. The infeed channel redirects the movement of the material essentially radially outwardly in relation to the center of the rotating means. In U.S. Pat. No. 6,206,309 B1 there is disclosed an apparatus for refining lignocellulosic material between two relatively rotating elements. The rotary element is provided with a central feeding means comprising an axial screw and wings. In U.S. Pat. No. 4,396,161 there is disclosed a disk refiner for cellulose, paper or equivalent pulp provided with guiding vanes. The vanes are provided on the stator side of the refiner.

None of these proposed technologies are however optimal, hence there is a continued need in the art to further improve the pulp distribution for a pulp refiner. There is also a need to improve the distribution of the pulp in a way that softens the problems related to pulp getting stuck and piled up in the middle of the center plate.

SUMMARY OF THE INVENTION

It is one object of the present invention to provide a center plate for a rotor. In particular it is desirable to improve the efficiency of pulp distribution in a pulp refiner.

In accordance with the present invention these and other objects have now been realized by the discovery of a center plate for a rotor and a pulp refiner, the center plate having a surface including a central portion and a periphery and provided with a plurality of first wings for directing pulp flowing onto the center portion of the center plate towards the periphery of the center plate, wherein each of the plurality of first wings comprises an arc-shaped protrusion extending between a corresponding first point and a corresponding second point on the surface of the center plate, the first point being displaced from the center portion of the center plate and the second point being disposed further from the center portion of the center plate then the first point, the plurality of first wings having an arc shape that yields a larger pulp feeding angle then a circular arc intersecting the center portion of the center plate and ending in the same corresponding second point, and wherein the second point of each of the plurality of first wings lies on the periphery of the center plate. Preferably, the surface comprises a flat surface or a surface with a central protuberance.

In accordance with one embodiment of the center plate of the present invention the arc shapes of each of the plurality first wings are defined by circular arc extending between a corresponding first point and a corresponding second point having a chord that is longer than the chord of a circular arc beginning in the center portion of the center plate and ending in the same corresponding second point.

In accordance with another embodiment in the center plate of the present invention the first points of the plurality of first wings are symmetrically distributed around the center portion of the center plate.

In accordance with another embodiment in the center plate of the present invention the center plate comprises of plurality of second wings, wherein each of the plurality of second wings defines an arc shape profile protruding from the surface and each of the plurality of second wings is attached to a corresponding one of the plurality of first wings in a contact section and extends between the contact section and an end point. Preferably, each of the plurality of second wings further comprises a tongue portion contacting a first contact section of a corresponding one of the plurality of first wings, and an arc shaped portion attached to the tongue portion in a second contact section and having substantially the same arc shape as the corresponding one of the plurality of first wings. In another embodiment the height above the surface of the center plate of each of the plurality of second wings varies from a lowest height in the vicinity of the contact section to a highest height located between the contact section in the end point. Preferably, the highest height is located in the vicinity of the contact section. In another embodiment the arc shaped second sections of the plurality of second wings extend between the second contact section and the periphery of the center plate.

In accordance with the present invention a pulp refiner has also been discovered including a rotor and a stator, the rotor including a center plate having a surface including a central portion and a periphery and provided with a plurality of first wings for directing pulp flow onto the center portion of the center plate towards the periphery of the center plate, wherein each of the plurality of first wings comprises an arc shaped protrusion extending between a corresponding first point and a corresponding second point on the surface of the center plate, the first point being displaced from the center portion of the center plate and the second point being disposed further from the center portion of the center plate then the first point, the plurality of first wings having an arc shape that yields a larger pulp feeding angle than a circular arc intersecting the center section of the center plate and ending in the same corresponding second point, and wherein the second point of each of the plurality of first wings lies on the periphery of the center plate.

In further accordance with the present invention, the above and other objects are obtained by means of a center plate for a rotor in a pulp refiner. The center plate has a surface provided with a plurality of first wings for directing pulp flowing onto the center of the center plate towards the periphery of the plate. Wherein the surface is a flat surface or a surface with a central protuberance and where each of the first wings is an arc-shaped protrusion extending between a corresponding first point and a corresponding second point on the surface. The first point is displaced from the center point of the plate and the second point is arranged farther from the center point than the first point.

It is a further object of the present invention to provide a center plate where each of the first wings, which are extending between corresponding first and second points, are given an arc-shape that yields a larger distribution angle than a circular arc intersecting the center point of the center plate and ending in the same corresponding second point.

It is a still further object of the present invention to provide a pulp refiner with an efficient grinding performance; this is obtained by means of a pulp refiner equipped with a rotor having a center plate according to above.

Yet more objects and embodiments of the invention will be given in the detailed description.

BRIEF DESCRIPTION OF THE DRAWINGS

The present invention, together with further objects and advantages thereof, may best be understood by making reference to the following description taken together with the accompanying drawings, in which.

DETAILED DESCRIPTION

Throughout the drawings, the same reference numbers are used for similar or corresponding elements.

To facilitate the understanding of the invention, there will first be given a general description of a pulp refiner and the functionality of such a refiner during use.

Figure 1:
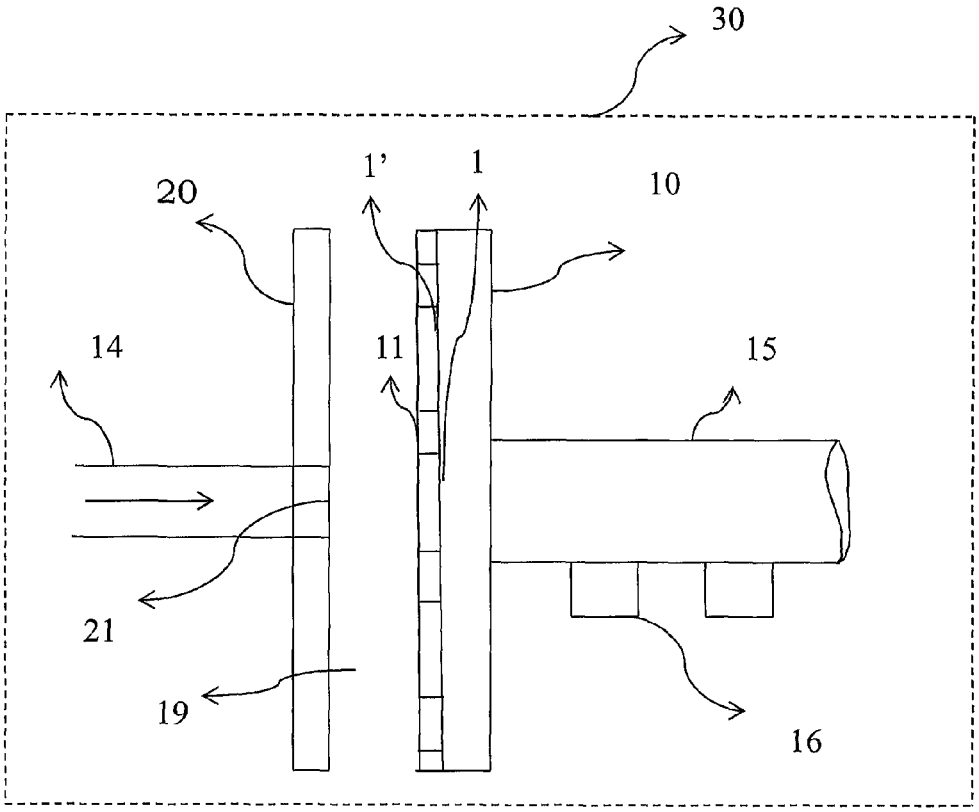
FIG. 1 is a side, elevational, schematic view of an example of a pulp refiner in accordance with the present invention.

Reference is made to FIG. 1, which schematically shows an exemplary pulp refiner in a cross-sectional view. The arrangement is housed in a housing 30 that represents the outer casing of the refiner device together with all components of said device that is not essential for understanding the present invention. Examples of components not shown are an electrical motor for driving e.g. the rotation axis, the feeding mechanism for the pulp etc. Inside the housing a rotor 10 and a stator 20 are linearly aligned along an axis. The rotor is attached to a rotation axis 15 arranged on bearings 16. The rotation axis 15 is connected to a motor, not shown, that rotates the axis 15, and thus the rotor 10. The stator 20 facing the rotor 10 is provided with a centrally located through hole 21. The through hole 21 extends between the feeding channel 14 for pulp and the refining zone 19. The rotor 10 is provided with a center plate 1 having a surface 1' facing the incoming pulp. The surface 1' of the center plate 1 is furthermore provided with first wings 11 for directing the pulp outwards toward the outer areas of the refining zone. In the outer areas of the refining zone are the rotor and/or the stator provided with refining segments for grinding the pulp. These grinding segments are often protrusions on the surfaces of the rotor/stator intended to enhance the grinding action of the pulp. These refining segments form no part of the present invention and will not be described any further.

During use pulp will be fed by means of a feeding mechanism, not shown, through the feeding channel 14. The pulp will pass through the hole 21 in the stator 20 and enter the refining zone 19. This refining zone 19 is defined by the gap between the rotor 10 and the stator 20 and can be quite small during operation. The pulp flowing into the refining zone 19 will be incident on the surface 1' of the center plate 1 on the rotor 10. A number of first wing profiles or first wings 11 provided on the surface 1' of the center plate 1 are used to steer the pulp out towards the outer parts or the rim of the refining area. On the outer part of the refining area the earlier mentioned refining segments will ensure an efficient grinding of the pulp.

As has been explained earlier, the choice of shapes for the wings to obtain a more efficient pulp distribution is a notoriously non-trivial subject since the motion of the pulp during the rotors rotation give rise to very complicated dynamics including turbulence. The inventor has found that a substantially more efficient pulp distribution can be obtained by providing a flat center plate 1 or a center plate 1 with a centrally located protuberance 110, with a number of arc-shaped first wings 11 that begin on first points 11*a* that are displaced from the center point 100 of the center plate 1. With such a center plate problems related to turbulence will be mitigated.

The center plate 1 according to the invention will also soften problems related to the fact that pulp can get stuck and pile up in the middle of a prior art center plate during an initial period of time. This problem depends at least partly on the fact that a substantial part of the pulp initially will flow in on the center plate at positions relatively far from the center point 100. Since prior art wings begin at the center point of a center plate 1 it will take some time before the wings get control of the pulp and can distribute it towards the rim. During the time it takes for the wings to control the pulp, the pulp will remain within the central area of the center plate 1. Since there is a continuous inflow of pulp onto the central area the pulp tends to pile up in the central area. This can in turn affect the pulp distribution negatively. By designing a center plate according to the present invention means are provided to quickly control the pulp that is flowing in on the center plate 1 at a distance from the center point 100. This is achieved by means of first wings 11 having first points 11*a* displaced from the center point 100 of the center plate 1. Since the inflowing pulp is controlled at a quicker rate it can be distributed towards the rim at a quicker rate. Therefore the present invention provides for a center plate 1 that yields an even distribution of pulp in a short period of time.

Figure 2:
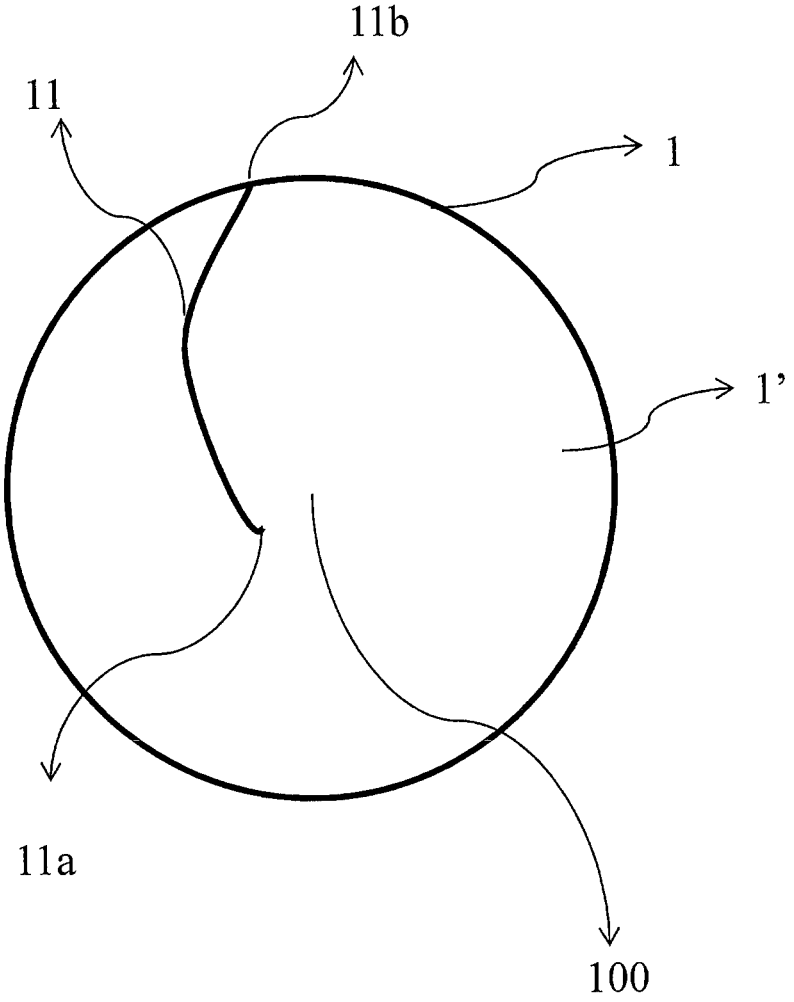
FIG. 2 is a front, elevation view of an example of one embodiment of a center plate for a rotor in accordance with the present invention.

An embodiment of a center plate 1 that contains a single first wing 11 is schematically disclosed in FIG. 2.

In FIG. 2 a surface 1' of the center plate 1 is provided with a curved first wing 11. The first wing 11 has a corresponding first point 11*a* that is displaced from the center of the plate 1. As can be discerned from FIG. 2 the first wing 11 define an arc-shaped form that begins on the first point 11*a* and ends on a second point 11*b* closer to the periphery of the center plate 1. For clarity there is only depicted a single first wing 11 in FIG. 2. The center plate would normally, during use, have a number of such first wings 11, preferably with their respective first points 11*a* arranged in a symmetrical fashion around the center point 100 of the plate 1. It is moreover also possible to provide first wings 11 that have a relative radial displacement. For example, by having one first wing 11 starting at point 11*a* and another first wing 11 starting at another first point 11*a* where the latter point is located closer to the periphery of the center plate 1 in the radial direction. In this way it is possible to provide a center plate 1 with a large number of first wings radially displaced along the surface 1' of the center plate 1. All these first wings 11 will have their corresponding first point 11*a* displaced from the center point of the surface 1' of the center plate 1. The first wings 11 are preferably integrally formed, for example integrally molded, with the center plate so that the center plate with its first wings 11 contain no loose parts. The center plate shown in FIG. 2, as well as the ones shown in FIGS. 3-11, is intended to be rotated counter clockwise when fitted to a rotor of a pulp refiner.

Figure 8:
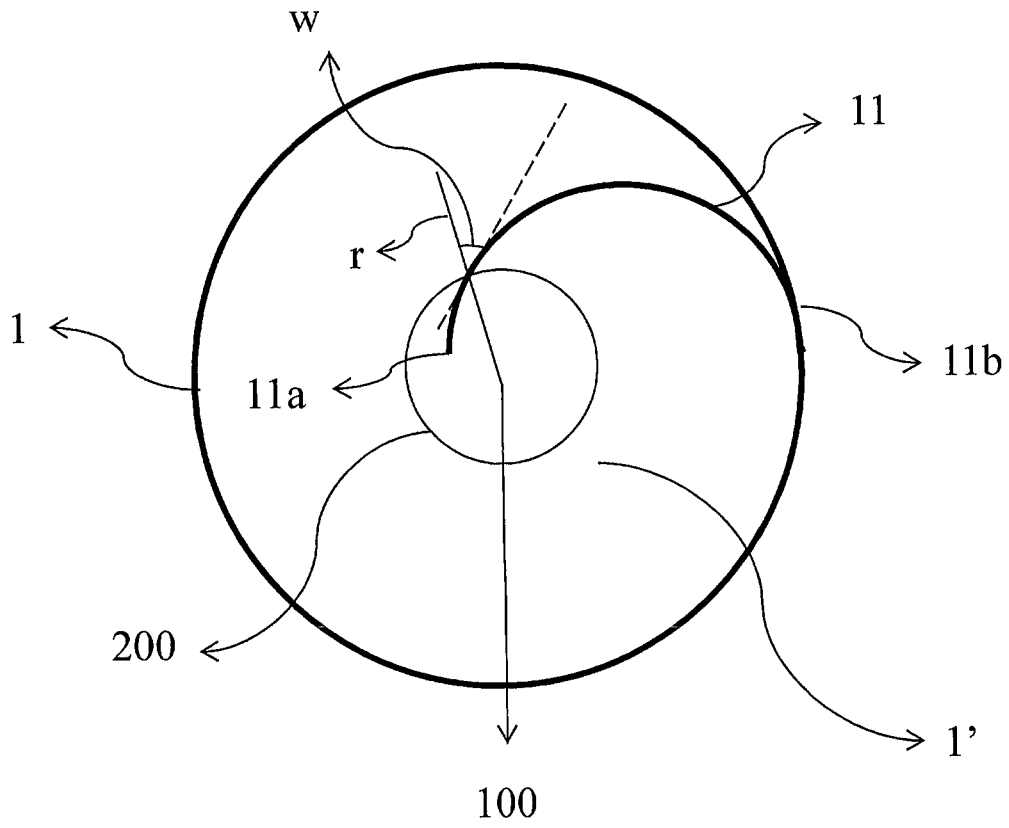
FIG. 8 is a front, elevational, partially schematic view of the pulp feeding angle for a center plate in accordance with the present invention.

To further clarify the shape of the arcs that defines the first wings 11 reference is made to FIG. 8. In FIG. 8 it is shown a center plate 1 with a single first wing 11. There is furthermore disclosed an inner circle denoted 200. During use of a center plate 1 in a refiner, the pulp will usually flow onto the center plate in a limited central area. This area can be adequately approximated by a circle centered at the center point 100 of the center plate 1. In FIG. 8 the inner circle 200 is intended to symbolize this limited central area. The inventor has found that an improved pulp distribution can be obtained by providing the center plate with arc-shaped first wings 11 that follows an arc that yields particular values for the pulp feeding angle. In FIG. 8 this angle is denoted w.

The above mentioned pulp feeding angle w for a first wing 11 can be determined through the following steps, where reference is made to FIG. 8:

Approximate the central area where the pulp flows onto the surface 1' of the center plate 1 with a circle 200;

Draw a line r from the center point 100 of the circle 200 in such a way that the line crosses the point where said circle 200 intersects with the arc-shaped first wing 11;

Draw the tangent for the arc-shaped first wing 11 in said point;

The pulp distribution angle w is then defined as the angle between the tangent of the arc-shaped first wing 11 in said point and the line extending from the center point and crossing the intersecting point between the circle 200 and the arc-shaped first wing 11.

According to the invention the first wings 11 should be designed to have an arc-shape that gives a pulp feeding angle w that is larger than the pulp feeding angle for a circular arc that begins in the center point 100 of the circle 200 and ends at the same second point 11*b* as the arc-shaped first wing 11. These are the particular values of the pulp feeding angle w mentioned above.

To design first wings 11 with arc-shapes that give efficient pulp feeding angles the first point 11*a* for the first wing 11 should be provided within the area of the circle 200 that approximates the area of the center plate 1 onto which the pulp initially flows. In most cases this area corresponds more or less to the area of the centrally located through hole 21 in the stator 20. That is the area of the circle 200 should be more or less the same as the area of the through hole 21 in the stator 20 through which pulp from the pulp feeding channel 14 enters the area between the stator 20 and the rotor 10.

Figure 9:
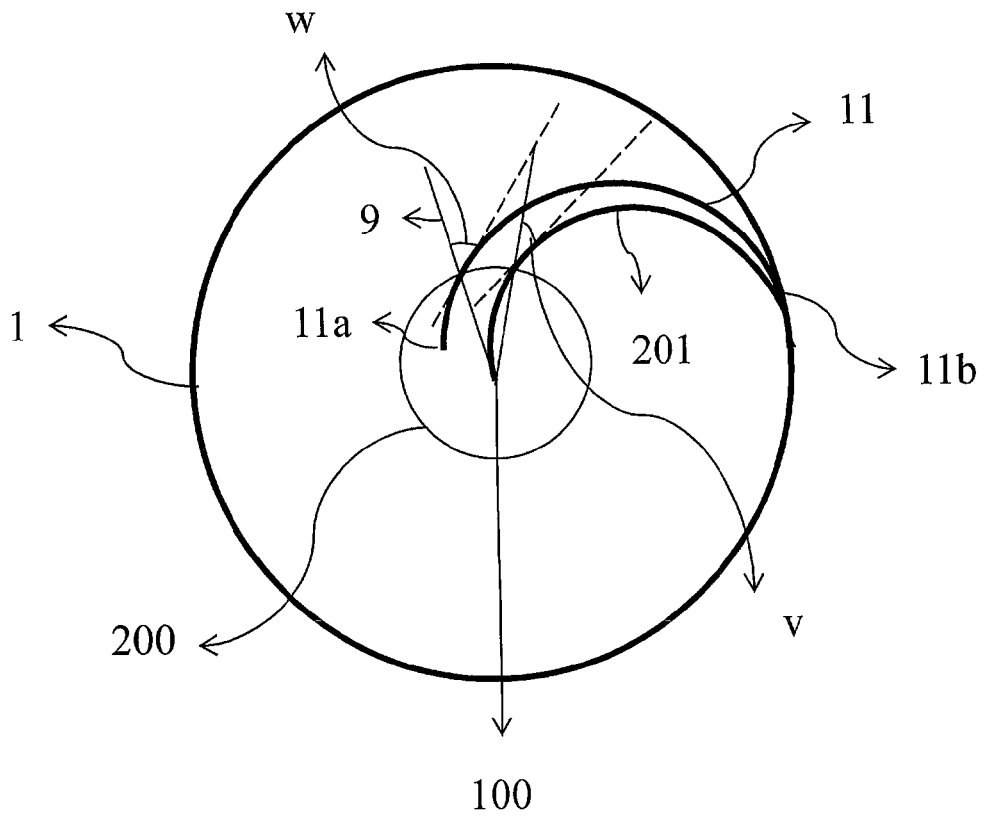
FIG. 9 is a front, elevational, partially schematic view of another pulp feeding angle for a center plate for a rotor in accordance with the present invention.

In FIG. 9 it is shown a comparison between a first wing 11, starting in a first point 11*a* and ending in a second point 11*b*, and a circular arc 201 beginning in the center point of a circle 200 and ending in the same second point 11*b* as the first wing 11. Here it is clear that the pulp feeding angle w of the first wing 11 is larger than the pulp feeding angle v of the circular arc 201. The pulp feeding angle v of the circular arc 201 can of course be determined by applying the steps given above for determining the pulp feeding angle of the first wing 11.

One preferred embodiment that yields the desired pulp feeding angle can be obtained by designing the first wing 11 so that it has the shape of a circular arc that extends between a first point 11*a* and a second point 11*b*. The first point 11*a* being displaced from the center point 100 of the center plate 1 in such a way that the chord of the arc-shaped first wing 11 is longer than the chord of a circular arc beginning in the center point 100 and ending at the second point 11*b*. With chord is here intended the straight line connecting the end points of the arc.

Another possible arc-shape for the first wings 11 is a more spiral shaped arc. That is, an arc whose end sections follows the shape of a circular arc but with a slightly flattened out mid-section. As long as the pulp feeding angle w is larger than the corresponding pulp feeding angle v for the circular arc 201 extending from the center point 100 one obtains an improvement in pulp distribution.

Figure 12:
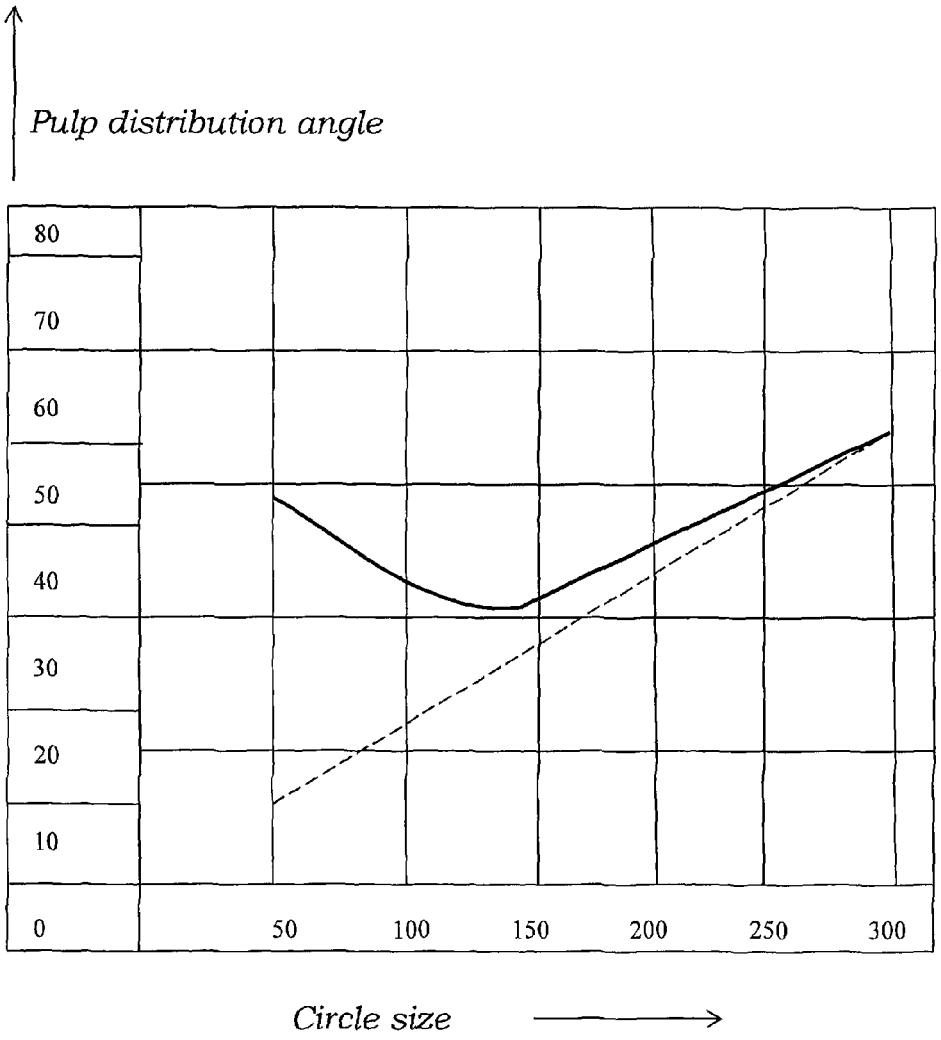
FIG. 12 is a graphical representation of the pulp feeding angle for an exemplary embodiment of the center plate for a rotor in accordance with the present invention.

In FIG. 12 there is shown a graph comparing the pulp feeding angle for two different arc shapes, such as the ones shown in FIG. 9. The dotted line shows the pulp feeding angle v of a circular arc beginning in the center point 100, while the solid line shows the pulp feeding angle of a circular arc beginning on a first point 11*a* that is displaced from the center point 100. In this example is the chord of the circular arc beginning in the center point 300 mm while the chord of the circular arc with a first point 11*a* displaced from the center point is 330 mm. The x-axis in the graph gives the radius of a circle 200 that approximate the central area upon which the pulp flows in.

By designing a center plate 1 provided with such first wings 11 one surprisingly obtain a more efficient distribution of pulp to the area of the refining segments on the outer part of the rotor-stator arrangement. In the end a more efficient grinding of the pulp is obtained. Moreover the larger values of the pulp feeding angles w for the first wings 11 give a faster transportation of pulp to the rim of the center plate 1. This will in turn reduce the emergence of turbulence. A faster transportation of pulp to the rim is usually accomplished by means of increasing the rotation speed of the rotor. This is however an energy demanding operation so a center plate 1 with first wings 11 according to the invention provides for a less energy-consuming alternative for increasing the speed with which pulp is transported from the center area of the center plate 1 to the rim of the same.

Figure 3:
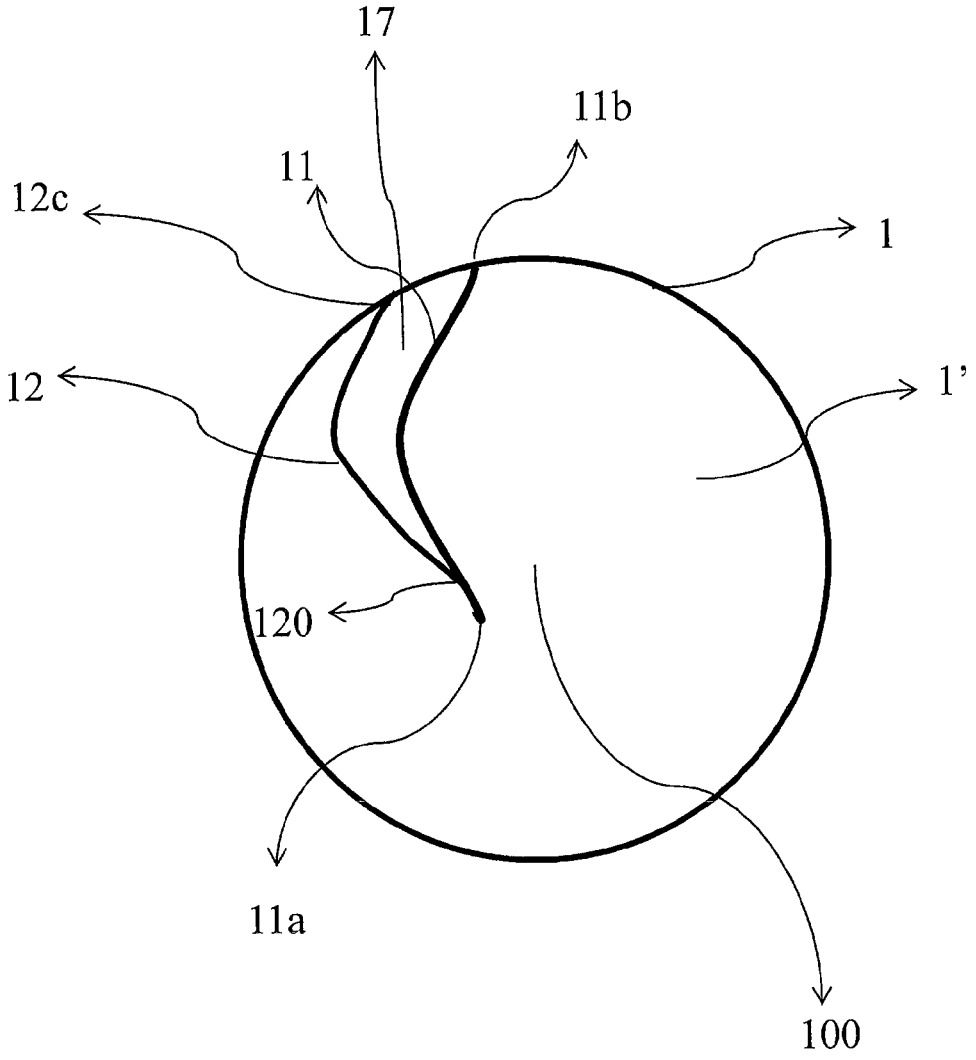
FIG. 3 is a front elevational view of another embodiment of a center plate for a rotor in accordance with the present invention.

Another exemplary embodiment of the center plate according to the invention is schematically depicted in FIG. 3. Here a second wing 12 is provided on the surface 1' of center plate 1. The purpose of this second wing 12 is to even further improve the distribution of pulp by means of creating more channels 17 into which pulp is directed. The second wing has a first contact section 120 in which the first and second wings 11, 12 connects. After the contact section 120, the second wing 12 follows an arc-shape that could be more or less the same arc-shape as for the first wing. It is however possible to provide the second wing with a different arc-shape, for example an arc-shape with a larger curvature than the first wing 11. In FIG. 3 the second wing 12 has its end point 12*c* on the periphery of the center plate. The wing 12 can in certain embodiments however end on another point within the area of surface 1'. The second wing 12 and an adjacent corresponding first wing 11 constitute the boundaries for a channel 17 into which pulp is directed. Since there usually is a plurality of first 11 and second 12 wings on the surface, a plurality of such channels 17 is provided on the surface 1'. These channels 17 will act to direct the pulp towards the rim of the center plate 1 in an even fashion.

Figure 4:
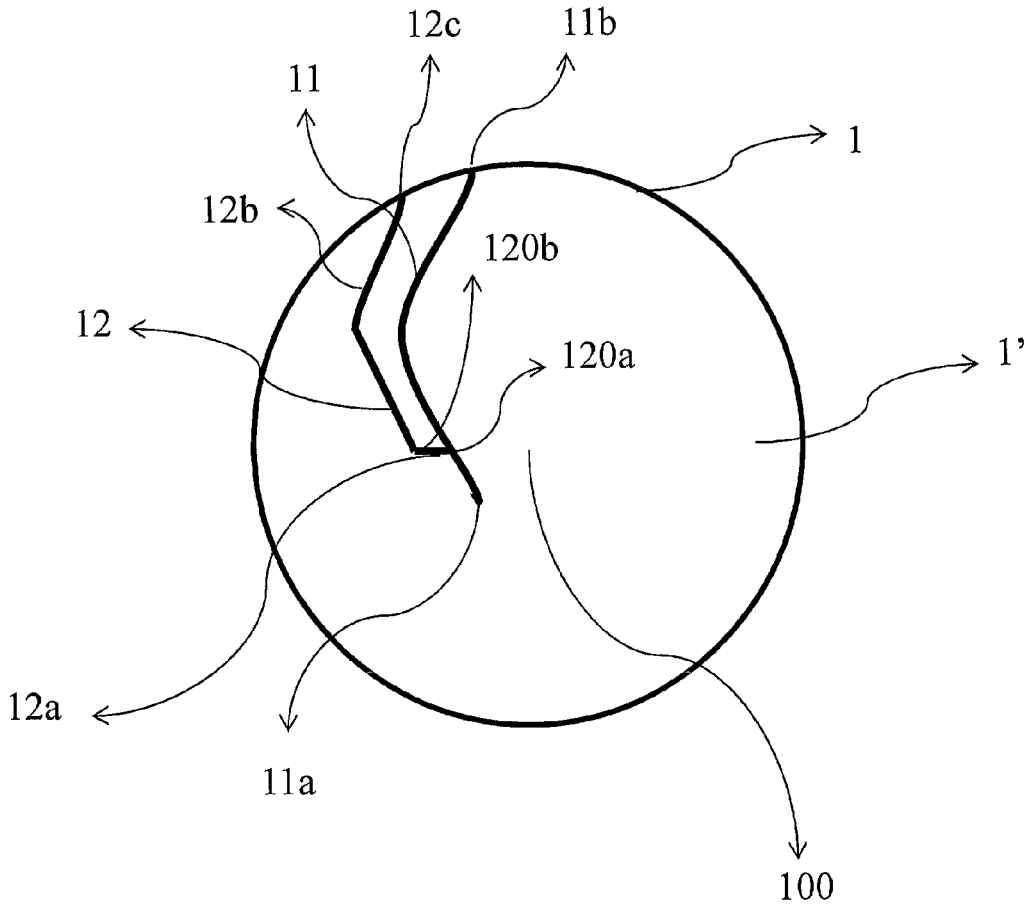
FIG. 4 is a front, elevational view of another embodiment of a center plate for a rotor in accordance with the present invention.

Another embodiment of center plate provided with first 11 and second 12 wings is shown in FIG. 4. Here the second wing 12 comprises two inter-connected portions 12*a* and 12*b*. The tongue portion 12*a* is attached to the first wing 11 in a contact section 120*a*. From this section the tongue portion 12*a* extends towards a second contact section 120*b*. In the second contact section 120*b* the tongue portion 12*a* is connected to an arc-shaped portion 12*b*. In this embodiment the tongue portion 12*a* together with the arc-shaped portion constitutes the second wing 12. In FIG. 4 the second wing 12 ends on the periphery of the center plate 1. As was the case with regard to FIG. 2, only a single first wing 11 and corresponding second wing 12 is shown to obtain a clearer drawing. Normally the center plate 1 would include a number of first wings 11 and a number of corresponding second wings 12. A schematic example of how such a plate 1 could look is given in FIG. 5. Here the plate 1 is provided with four first wings 11 with corresponding second wings 12. This is purely illustrative; the number of first wings 11 could be smaller or larger and it is also possible to only provide a sub portion of the first wings 11 with second wings 12. As for the first wings 11 also the second wings 12 are preferably integrally formed on the center plate 1 so that a single piece is obtained. In this way the center plate provided with its first 11 and second wings 12 contains no loose parts.

Figure 5:
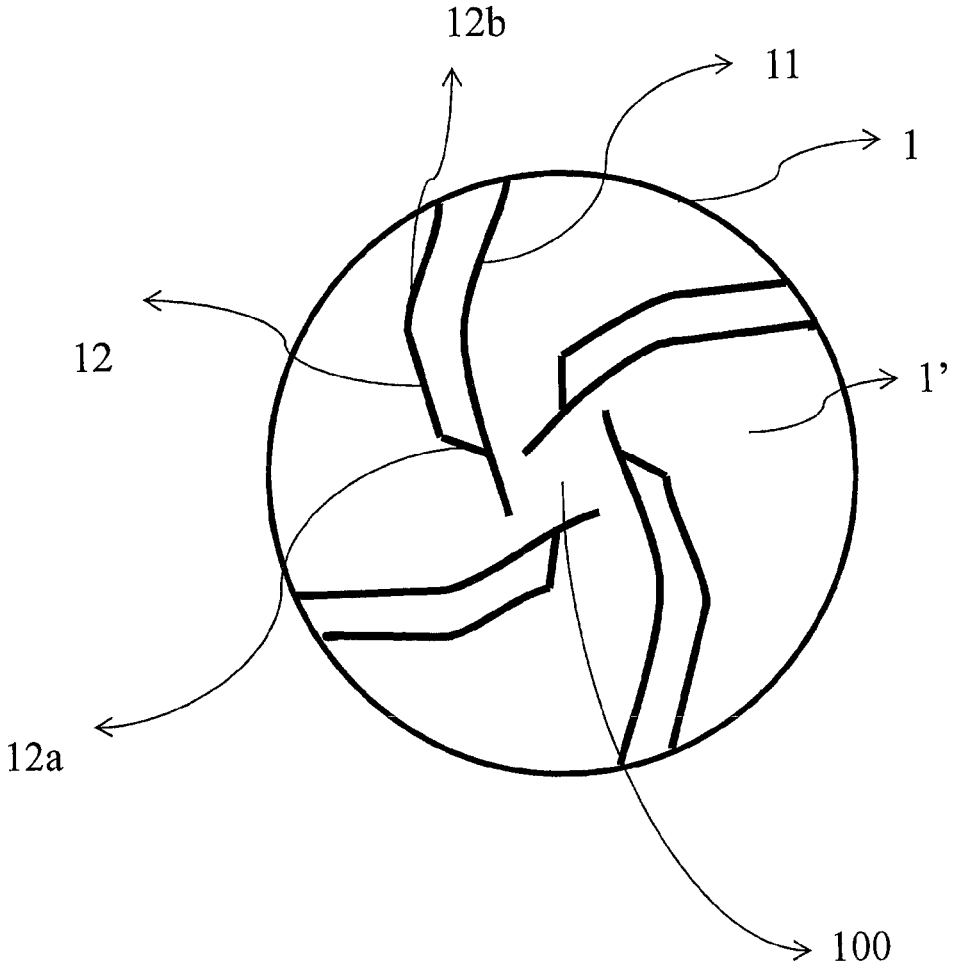
FIG. 5 is a front, elevational view of still another embodiment of a center plate for a rotor in accordance with the present invention.
Figure 10:
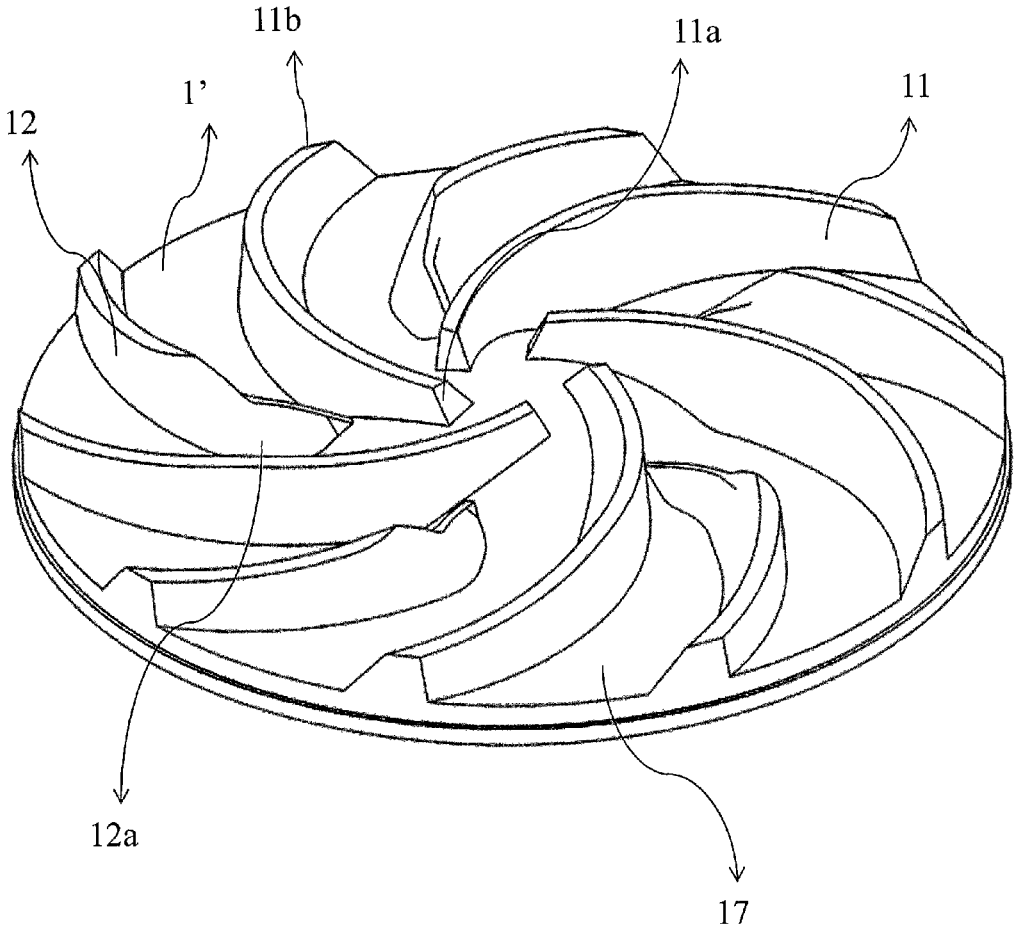
FIG. 10 is a side, prospective view of one embodiment of the center plate for a rotor in accordance with the present invention.
Figure 11:
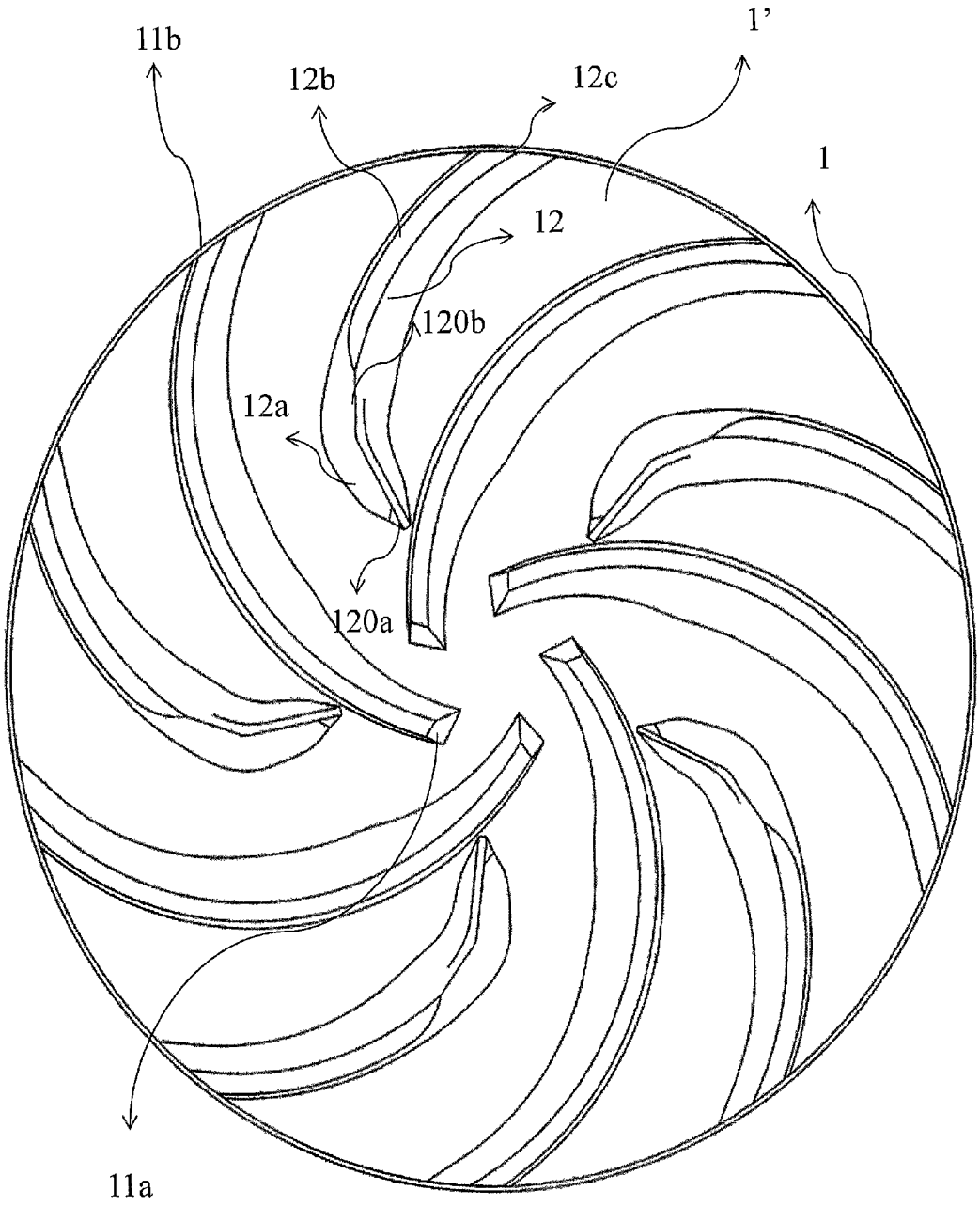
FIG. 11 is a top, elevational view of another embodiment of a center plate for a rotor in accordance with the present invention.

An alternative embodiment to the one described in relation to FIG. 5 is shown in some detail in FIGS. 10 and 11. In FIG. 11, the first points 11*a* of the first wings 11 and the contact section 120*a* of the second wings 12 are symmetrically arranged around the center point 100. Furthermore, in this exemplary embodiment, also the corresponding end points 11*b* and 12*c*, respectively, are arranged symmetrically on the periphery of the surface 1' of the center plate 1. Since it is five first wings 11 and five second wings 12 in FIG. 11 their corresponding end points have a relative angular displacement of 360°/5=72°. It can also be discerned from FIG. 11 that the tongue portion 12*a* is connected to the first wing 11 in a contact point or contact section 120*a*, the tongue portion extends from this section 120*a* in a slightly angled direction towards the contact point or contact section 120*b*. After this point 120*b* the second wing 12 goes over into an arc-shaped form 12*b* that ends in a point or a segment 12*c*. The arc-shaped portion 12*b* of the second wing 12 could have essentially the same shape as the first wing 11, i.e. circular arc-shape or others. Given a specific arc-shape of the first wing 11 it is however possible to provide a different arc-shape for the arc-shaped portion 12*b* of the second wing.

A further exemplary embodiment of the second wings 12 described above with regard to FIGS. 3-5, relates to the shape of the second wings 12 in the vicinity of the contact section 120, 120*a* with the first wings 11. One of the purposes of the second wings 12 is to ascertain a more even distribution of pulp. The second wings 12 provide a means for obtaining this by creating more channels 17 for the pulp to flow in. A further improvement is to provide the second wings with a varying height above the center plate 1 in the area closest to the connection section 120, 120*a*. In this way pulp that is directed from the first wing 11 will partly be allowed to pass over the second wings 12 and enter the channel 17 that is bounded by the adjacent first 11 and second 12 wings. Thus part of the pulp will flow over the second wing 12 and part will pass alongside the second wing 12. This leads to an even distribution of pulp on the surface 1' of the center plate 1.

In the embodiment described with regard to FIG. 4, it is the tongue portion 12*a* of the second wing 12 that has a varying height over the center plate 1. The height is lowest in the vicinity of the first contact section 120*a* and then rising to be at the highest in the vicinity of the second contact section 120*b*. In this way part of the pulp will be allowed to pass over the tongue into the channel 17 defined by adjacent first 11 and second 12 wings. This could be understood by studying FIG. 10. Possible values of the height relations for the tongue portion are that the lowest height over the surface 1' is about half the value of the highest height over the surface 1'.

For the embodiment described with regard to FIG. 3 the arc-shaped second wing 12 has a lowest height over the center plate 1 in the vicinity of the contact section 120. The height is then increasing to a highest value at a location somewhere along the arc 12 between the contact section 120 and the end point 12*c*. The precise location of the highest point of the second wings depends on the area of the circle 200 that approximate the area on the center plate 1 that the pulp initially flows into. This area is more or less the same as the area of the centrally located through hole 21 in the stator 20. Possible locations for the highest point of the second wing 12 are either at the same radial distance as the periphery of the circle 200 or at a radial distance outside the circle 200, closer to the periphery of the center plate 1.

Figure 6:
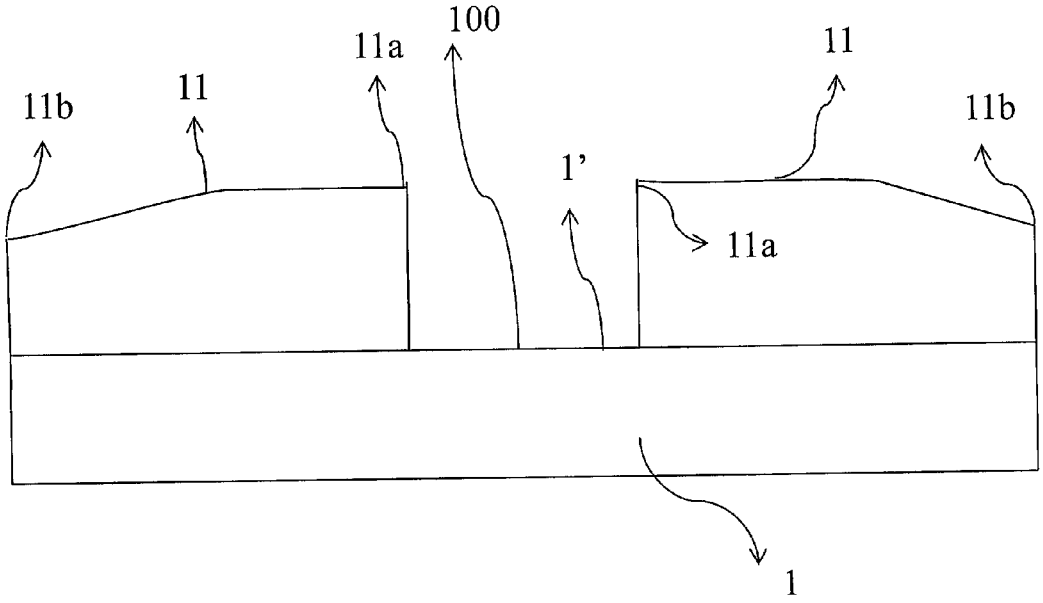
FIG. 6 is a side, elevational view of one embodiment of a center plate for a rotor in accordance with the present invention.
Figure 7:
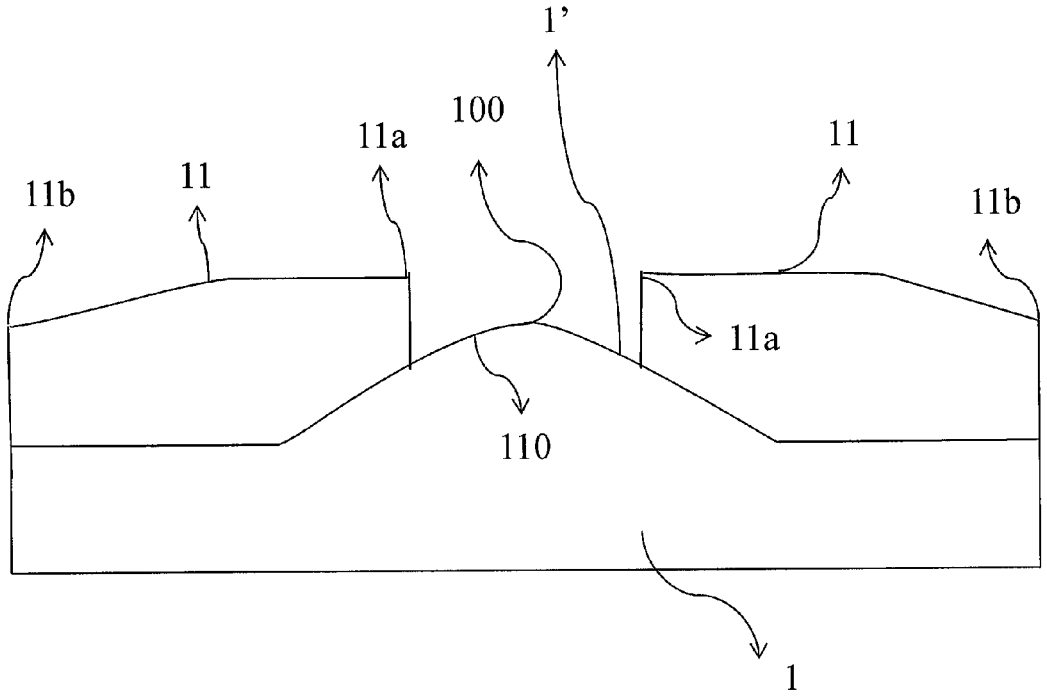
FIG. 7 is a side, elevational view of another embodiment of a center plate for a rotor in accordance with the present invention.

All embodiments described earlier concerns first and second wings 11, 12 arranged on a surface 1' of a center plate 1 for a rotor. The surface 1' can in these embodiments be a flat surface or an essentially flat surface, one such embodiment is shown in a cross-sectional side view in FIG. 6. FIG. 6 also shows one possible height profile of the first wings 11. The height above the center plate is smallest at the periphery of the center plate 1 and grows toward a highest point. After the highest point the height profile goes over into a plateau shape that ends in point 11*a*. By way of example, the largest value of the height of the first 11 and second 12 wings above the surface 1' could be 1/10-1/3 of the diameter of the center plate 1. More specifically the height could be around 1/7-1/5 of the diameter of the central plate.

It is also possible to provide the surface 1' with a central protuberance 110 or a bulge/bump. This is illustrated in a side view of the center plate 1 in FIG. 7. The purpose of the central protuberance 110 is to strengthen the central area of the center plate 1. Since the pulp will mainly fall into the central area of the center plate 1 and change direction there, from an axial motion along the feeding axis to a radial motion along the surface 1' of the center plate 1, significant forces will be applied on the sides of the first wings 11 from the pulp. By providing the central plate 1 with a central protuberance 110 a more robust central plate 1 is obtained since the height of the first wings 11 above the protuberance 110 is smaller than the height of the wings 11 above an essentially flat surface.

Preferably the protuberance 110 is a smooth protuberance without sharp ends, this to avoid possible irregularities in the flow which could lead to a turbulent motion of the pulp. The height of the protuberance above the surface 1' of the central plate 1 should preferably not exceed the highest point of the height profile of the first wings 11. This is to ascertain that the inflowing pulp initially will be brought into contact with the first wings 11 and not with the protuberance 110. In this way the distribution of the pulp will begin as soon as the pulp falls onto the center plate 1.

Through the described designs, it is provided center plates 1 that display tremendous pulp distribution characteristics. The center plates 1 have an uncomplicated construction which makes them easier and less costly to produce. Since they are also robust they are less prone to be damaged. The fact that they contain no loose parts will make them easy to exchange if worn down.

All embodiments of a center plate 1 as described earlier can be fitted to a rotor arrangement of well-known pulp refiners. One example of such a pulp refiner 30 is schematically described above with reference to FIG. 1.

Other refiners are however also possible. Such refiners include refiners equipped with two rotors instead of a rotor-stator arrangement. For example two rotors that can be rotated independently.

All the embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

The invention claimed is:

1. A pulp refiner comprising a rotor, a stator, a center plate for the rotor, said center plate having a first surface including a central portion and a periphery adjacent to a refining area including grinding segments on said rotor, said first surface being further provided with a plurality of wings for directing pulp flowing onto said center portion of said first surface of said center plate towards said periphery of said first surface of said center plate whereby pulp enters said refining area on said rotor and is ground by said grinding segments in said refining area, wherein each of said plurality of wings comprises an arc-shaped protrusion extending between a corresponding first point and a corresponding second point on said first surface of said center plate, said first point being displaced from said center portion of said center plate and said second point being disposed further from said center portion of said center plate than said first point, said plurality of wings having an arc shape that yields a larger pulp feeding angle than a circular arc intersecting said center portion of said center plate and ending in the same corresponding second point, and wherein said second point of each of said plurality of wings lies on said periphery of said center plate, and wherein said arc-shapes of each of said plurality of wings are defined by a circular arc extending between a corresponding first point and a corresponding second point having a chord that is longer than the chord of a circular arc beginning in said center portion of said center plate and ending in the same corresponding second point, said chord being defined as a straight line connecting the end points of said arc.

2. The pulp refiner of claim 1, wherein said first surface comprises a flat surface or a surface with a central protuberance.

3. The pulp refiner of claim 1, wherein said first points of said plurality of wings are symmetrically distributed around the center portion of said center plate.

4. The pulp refiner of claim 1, wherein said wings comprise a plurality of first wings, and further comprising a plurality of second wings, wherein each of said plurality of second wings defines an arc-shaped profile protruding from said surface, and each of said plurality of second wings is attached to a corresponding one of said plurality of first wings in a contact section and extends between said contact section and an end point.

5. The pulp refiner of claim 4, wherein each of said plurality of second wings further comprises a tongue portion contacting a first contact section of a corresponding one of said plurality of first wings, and an arc-shaped portion attached to said tongue portion in a second contact section and having substantially the same arc shape as said corresponding one of said plurality of first wings.

6. A pulp refiner of claim 5, wherein said arc-shaped second portions of said plurality of second wings extend between said second contact section and said periphery of said center plate.

7. The pulp refiner of claim 4, wherein the height above the surface of said center plate of each of said plurality of second wings varies from a lowest height in the vicinity of said contact section to a highest height located between said contact section and said end point.

8. The pulp refiner of claim 7, wherein said highest height is located in the vicinity of said contact section.

* * * * *